US006269876B1

(12) United States Patent
De Rouffignac et al.

(10) Patent No.: US 6,269,876 B1
(45) **Date of Patent: *Aug. 7, 2001**

(54) ELECTRICAL HEATER

(75) Inventors: Eric De Rouffignac; Harold J. Vinegar, both of Houston; Lawrence James Bielamowicz, Bellaire, all of TX (US)

(73) Assignee: Shell Oil Company, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/264,436

(22) Filed: Mar. 8, 1999

Related U.S. Application Data

(60) Provisional application No. 60/077,022, filed on Mar. 6, 1998.

(51) Int. Cl.[7] ..... E21B 36/04; E21B 43/02

(52) U.S. Cl. ..... 166/60; 166/302; 392/305

(58) Field of Search ..... 219/415, 417, 219/418; 166/288, 302, 57, 60, 61, 248; 392/305, 306

(56) References Cited

U.S. PATENT DOCUMENTS

| | | | | |
|---|---|---|---|---|
| 2,548,360 | * | 4/1951 | Germain | 166/60 |
| 2,732,195 | | 1/1956 | Ljungstrom | 166/302 |
| 2,808,110 | * | 10/1957 | Spitz | 166/61 |
| 3,131,763 | * | 5/1964 | Kunetka et al. | 166/60 |
| 4,276,936 | * | 7/1981 | McKinzie | 166/303 |
| 4,522,262 | * | 6/1985 | Perkins | 166/248 |
| 4,620,593 | * | 11/1986 | Haagensen | 166/248 |
| 4,640,352 | | 2/1987 | Vanmeurs et al. | 166/245 |
| 4,790,375 | * | 12/1988 | Bridges et al. | 166/60 |
| 4,886,118 | | 12/1989 | Van Meurs et al. | 166/245 |
| 5,070,533 | * | 12/1991 | Bridges et al. | 392/301 |
| 5,244,310 | | 9/1993 | Johnson | 405/128 |
| 5,318,116 | | 6/1994 | Vinegar et al. | 166/60 |
| 5,417,282 | * | 5/1995 | Nix | 166/248 |

* cited by examiner

*Primary Examiner*—David Bagnell
*Assistant Examiner*—Jennifer R. Dougherty
(74) *Attorney, Agent, or Firm*—Del S. Christensen

(57) ABSTRACT

A heater is disclosed, the heater including: a porous metal sheet heating element; and an electrical insulating material surrounding the porous metal sheet heating element; wherein there is no casing surrounding the porous metal sheet heating element.

14 Claims, 2 Drawing Sheets

ELECTRICAL HEATER

This application claims the benefit of U.S. Provisional Application No. 60/077,022 filed Mar. 6, 1998, the entire disclosure of which is hereby incorporated by reference.

FIELD OF THE INVENTION

This invention relates to a electrical heating method and apparatus useful in a borehole.

BACKGROUND TO THE INVENTION

U.S. Pat. Nos. 4,640,352 and 4,886,118 disclose conductive heating of subterranean formations of low permeability that contain oil to recover oil therefrom. Low permeability formations include diatomites, lipid coals, and oil shales. Formations of low permeability are not amiable to secondary oil recovery methods such as steam, carbon dioxide, or fire flooding. Flooding materials tend to penetrate formations that have low permeabilities preferentially through fractures. The injected materials bypass most of the formation hydrocarbons. In contrast, conductive heating does not require fluid transport into the formation. Oil within the formation is therefore not bypassed as in a flooding process. Heat injection wells are utilized to provide the heat for such processes.

Heat injection wells can also be useful in decontamination of soils. U.S. Pat. Nos. 5,318,116 and 5,244,310, for example, disclose methods for decontamination of soils wherein heat is injected below the surface of the soil in order to vaporize the contaminates. The heaters of patent '310 utilize electrical resistance of spikes, with electricity passing through the spikes to the earth. Patent '116 discloses heater elements passing through the wellbore to the bottom of the formation to be heated. The wellbore surrounding the heater includes a catalyst bed, which is heated by the heater elements. Heat conductively passes through the catalyst bed to a casing surrounding the catalyst bed, and then radiantly from the casing to the soil surrounding the wellbore. Typical alumina based catalysts have very low thermal conductivities, and a significant temperature gradient will exist through the catalyst bed. This significant temperature gradient will result in decreased heat transfer to the earth being heated at a limited heater element temperature.

U.S. Pat. No. 5,065,818 discloses a heater well with sheathed and mineral insulated ("MI") heater cables cemented directly into the wellbore. The MI cables includes a heating element surrounded by, for example, magnesium oxide insulation and a relatively thin sheathing around the insulation. The outside diameter of the heater cable is typically less than one half of an inch (1.25 cm). The heater well optionally includes a channel for lowering a thermocouple through the cemented wellbore for logging a temperature profile of the heater well. Being cemented directly into the wellbore, a need for a casing (other than the sheathing of the cable) is eliminated, but the outside diameter of the cable is relatively small. The small diameter of the heater cable limits the amount of heat that can be transferred to the formation from the heater cable because the area through which heat must pass at the surface of the cable is limited. A cement will have a relatively low thermal conductivity, and therefore, a greater heat flux at the surface of the cable would result in an unacceptably high heater cable temperature. Multiple heater cables may be cemented into the wellbore to increase the heat transfer to the formation above that which would be possible with only one cable, but it would be desirable to further increase the heat that can be transferred into earth surrounding the heaters.

U.S. Pat. No. 2,732,195 discloses an electrical heater well wherein an "electrically resistant pulverulent" substance, preferably quartz sand or crushed quartz gravel, is placed both inside and outside of a casing of a wellbore heater, and around an electrical heating element inside of the casing. The quartz is placed there to reinforce the casing against external pressures, and a casing that is sealed against the formation is required. The casing adds considerable expense to the installation.

It is therefore an object of the present invention to provide a wellbore heater wherein the heater has a greater surface area at the temperature of the electrical resistance element than those of the prior art, and in which a substantial casing is not required. This heater is useful as a well heater for such purposes as thermal recovery of hydrocarbons and soil remediation.

SUMMARY OF THE INVENTION

These and other objects are accomplished by an electrical heater comprising: a porous metal sheet heating element; and an electrical insulating material surrounding the porous metal sheet heating element; wherein there is no casing surrounding the porous metal sheet heating element. The casingless design of the present heater significantly reduces the cost of a heat injection well, which is significant in an application such as heat injectors for recovery of hydrocarbons from, for example, oil shales, tar sands, or diatomites. Heat injection can also be used to remove many contaminates.

DETAILED DESCRIPTION OF THE INVENTION

Figure 1:
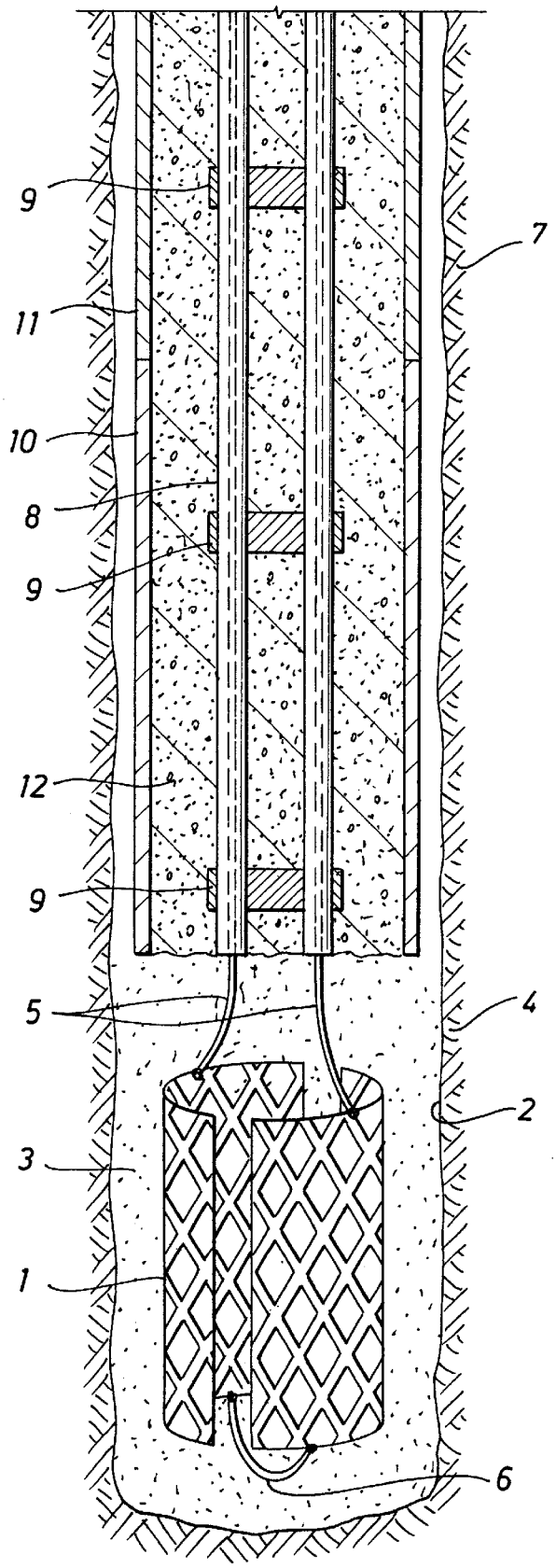
FIG. 1 shows a heater according to the present invention within a wellbore.

The heater of the present invention has a mesh heating element which can be formed to conform to a wall of a wellbore to maximize the surface of the heating element which is provided and to maximize the heat flux leaving the wellbore. An electrically insulating filler is placed around and inside of the heating element to essentially eliminate electrical shorting of the element to the formation. This electrically insulating material could be a material that is initially wet, and therefore electrically conducting until it is dried. The drying step could be accomplished by passing electricity through the heating element and into the wet material, and heat generated by the electrical energy would gradually heat the soil and eventually vaporize liquid water initially present. The remaining dry sand is an acceptable electrical insulator. Optionally, a hydraulic cement could be used in place of the sand. Hydration of the cement reduces free liquid water, and the cured cement can be an acceptable electrical insulator. Other materials could be used as the insulating material. Preferred materials are easily placed and inexpensive. An ideal material would also either be or readily become an electrically nonconducting material. A material such as sand could be placed pneumatically or as a slurry.

A plurality of electrical heating elements are preferably placed in the wellbore to form the heater, with the elements connected at the lower portion of the wellbore, and different phases of alternating electrical power applied to each of the elements. Two or three elements are preferred.

The heating elements can be expanded metal, or another porous metal element such as a wire screen or wire mesh. A porosity of between about forty percent and about eighty percent is preferred, where porosity is defined as the percent of open area looking at the surface of the sheet of material. Providing this open area considerably increases the total area contacted by the element, without reducing the thickness of the element. A thicker element provided greater allowances for corrosion. Thickness of the element is chosen to result in a voltage requirement at the targeted heat flux which is not excessively low or high. For example, a voltage differential of about 120 to about 960 volts of alternating current between the upper ends of two elements within a wellbore which have connected lower ends would be preferred. Generally, for longer lengths of meter (100 to 700 meters) from 480 to 960 volts is preferred and for shorter meters (2 to 200 meters) from 120 to 480 volts is preferred. To accommodate greater thicknesses of elements, multiple heaters could be provided in series, but the extent to which this can be done is limited by the expense of the cables leading to the heater elements. Power is preferably applied between two symmetrical heater elements wherein the net voltage is zero. Thus the voltage applied at one time to one electrode is the negative with respect to ground of the voltage applied to the other heater element.

The elements are preferably formed into a curved shape either at the surface or within the borehole to conform to the walls of the wellbore. The curved shape could be provided at the surface by a die through which the metal is passed as it is passed into the wellbore. The curved shape could be provided within the wellbore by a passing a mandril past the element. The mandril could, for example, be provided as a part of an apparatus which spreads the elements and places the electrical insulating material around and between the elements. When the elements are formed into a curved shape at the surface, centralizers and spacers can be added to the elements to keep the elements separated within the wellbore. Use of the mandrel as described above is preferred because centralizers and spacers can be eliminated, reducing the cost of materials. Flat mesh elements could be provided. The advantage of providing curved elements is that heat could be transferred from almost the entire circumference of the borehole, with two flat elements, heat could be transferred from a surface area of only about twice the diameter of the wellbore, but installation of the flat elements could be simplified compared to the semicircular shaped elements.

Generally, heater elements of stainless steel of, for example, grades 304 or 316 are preferred. INCLOY 600 could also be useful. 316 stainless steel is preferred when the elements will be exposed to brines because of the greater resistance of 316 stainless steel to chloride stress corrosion. Stainless steels are not excessively expensive, and would withstand exposure to elements that may be present during start-up phases for long enough to get the elements up to elevated temperatures, and sufficiently low corrosion rates when exposed to most borehole environments for extend periods of time at elevated temperatures. Typically, stainless steels are not utilized as heater elements because of limited high temperature corrosion resistance, but because of the relatively large surface area from which heat is transferred in the heater of the present invention, the elements surface temperature can be suitable for stainless steels. Carbon steels could also be used as heater elements for applications where high levels of heat do not have to be provided for extended periods of time.

Although in a preferred embodiment of the present invention includes the use of stainless steel as the heater element material, higher alloys could be useful in some applications of the present invention. For example, when the heater is applied in a relatively deep wellbore, the costs of providing the well could be much greater than the costs of the heater element material, and therefore a higher alloy could reduce total costs by permitting operation at higher temperatures and thus reducing the number of wells required for the same total heat duty.

Alternatively, the heating elements could be coated with a more corrosion restive metal surface, or a refractor surface to provide additional electrical insulation and protection. Thermocouples for control of the heaters could be provided within the wellbore, either inside of curved heater elements, outside of the elements, or attached to the heater elements (through an electrically insulating connection). The thermocouple could be used to monitor the operation, or to control electrical power applied to the heater element. When thermocouples are used to control the electrical power, multiple thermocouples could be provided and the a control temperature selected from the thermocouples. The selection could be based on a maximum temperature, an average temperature, or a combination such as an average of the highest two or three temperatures.

The heat elements of the present invention can be made to a wide variety of lengths because of the flexibility to select different combinations of voltages and porosities of the heater elements. Heaters as short as two to six meters can be used, and as long as two hundred to seven hundred meters could be provided.

A borehole within which the heater of the present invention is placed may be cased and cemented for at least a portion of the borehole above the heater, to ensure isolation of the formation to be heated. In a shallow well, the borehole may be filled with sand to the surface.

Referring now to FIG. 1, a schematic of the heater of the present invention is shown. A mesh heater element 1 is shown as two semicircular expanded metal plates within a wellbore 2. An electrically insulating filler 3 such as sand is shown surrounding and between the heating elements. The borehole is within a portion of the earth to be heated 4, such as a formation of oil containing diatomite, tar sands or oil shale. Alternatively, the earth to be heated 4 could be contaminated soil in a thermal desorption remediation process. Electrical leads 5 extend to each of the heater elements and the heater elements are electrically connected at the lower portion of the elements by connector 6. Alternatively, the elements could all be grounded at the base of the borehole. Electrical leads extend through the portion of the overburden which is not to be heated 7 through sheathed cables 8, the sheathed cables separated by spacers 9. A transition portion of the wellbore will be heated by the heater elements, but not to the temperatures that result in the portion of the borehole which contains the heater elements. This transition portion of the borehole is shown as cased by a casing 10, which may be of a metal such as stainless steel, which will have an acceptably long useful life when exposed to elevated temperatures. The corrosion environment within this transition volume may be more severe than the corrosion environment near the heaters because of the dew point temperature being within this region. Above the transition zone, the casing could be a carbon steel casing 11. The casing within the transition zone and the overburden 7 could be filled with a filler 12 such as sand or cement, or left void.

Figure 2A:
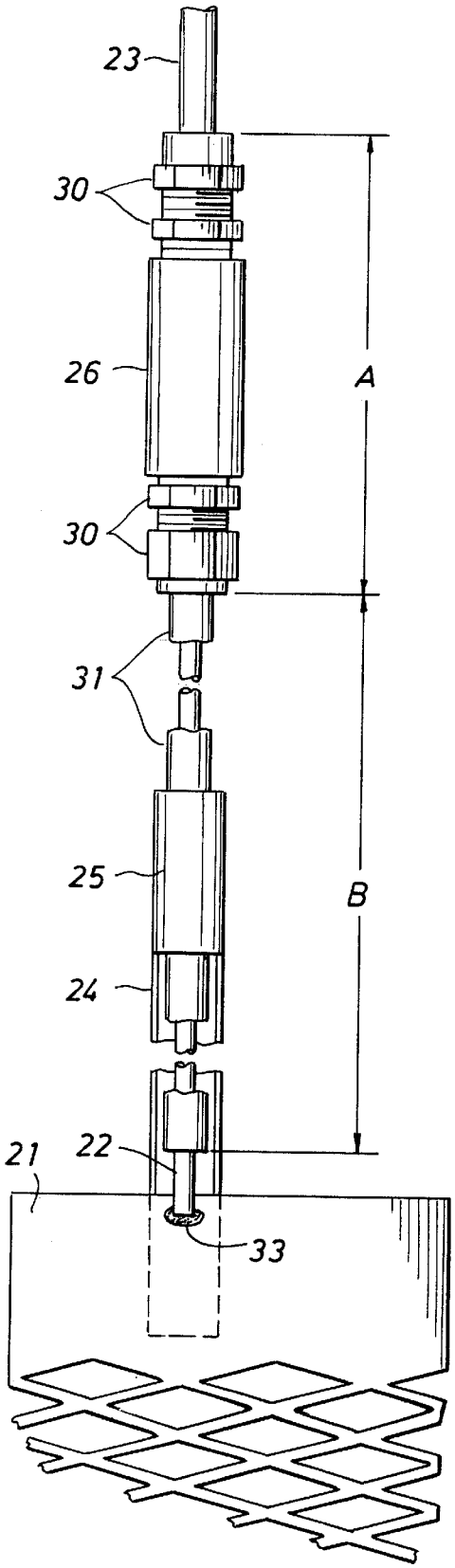
FIGS. 2A, 2B, and 2C show details of an electrical cable attached to the top of a heater according to the present invention.
Figure 2B:
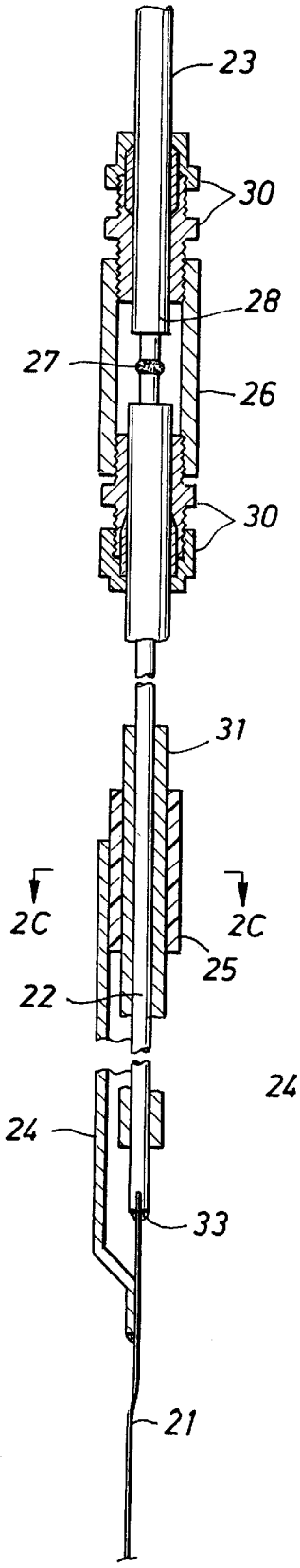
Figure 2C:
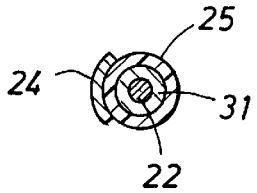

Referring now to FIGS. 2A, 2B, and 2C, three views with partial cutaways are shown of fittings for electrical cables and connections to the heater element of the present invention. The top of the heater element 21 is connected to a high temperature lead cable 22 by a weld connection 33. A waterproof interface between the cable and heater A is within a transition zone. Above the transition zone, an inexpensive cable such as a polyethylene coated copper wire could be used. An electrically insulated high temperature section B extends from the waterproof interface to the heater element. A stiffener 24 provides support for the electrical connection to the heater element. The stiffener is attached to the cable by a collar 25. The collar is an electrically insulating collar. The water proof interface includes a coupling 26 around a soldered connection 27, the soldered connection providing continuity between the high temperature lead cable 22 and a low temperature lead cable 28. The coupling is threaded to swedge fittings 30, which may be brass fittings, and which provide a friction fitting to each of the high temperature lead sheath 31 and the low temperature lead sheath 23. Low temperature lead cable 28 goes from the surface to just above the top of the heater and can be a copper core-copper sheathed mineral insulated cable. This type of cable is preferred because of its ability to carry very large amounts of electrical power, and because it is waterproof. Although the cable can withstand high temperatures, it is used at temperatures below the boiling point of water due to corrosion rates. A waterproof splice (A) terminates the low temperature lead cable 28 and forms a transition to a nickel or nichrome clad-nickel high temperature lead cable 22 that is connected with a weld 33 to the upper part of the heater element 21. The high temperature lead cable 22 can be insulated with a TEFLON sleeve to prevent corrosion of the high temperature lead cable 22 and provide a waterproof seal at the lower end of the swedge fittings 30. Stiffening arm 24 provides support to the TEFLON sleeved high temperature lead cable 22 during installation of the heater into a wellbore. The waterproof splice A can be about two to twenty feet above the top of the heater element. The water proof splice is far enough away from the heater so that the water proof splice remains at a temperature below the boiling point of water. The TEFLON coated high temperature lead is, at one point, exposed to the boiling point of water, and is easily capable of handling this environment. The lower (hotter) portion of the high temperature lead sheath 31 will eventually melt away, leaving exposed high temperature lead. Providing the TEFLON coating to this point ensures that the TEFLON extends past the point where the temperature is at the boiling point of water.

The high temperature lead sheathing could be any coating which would protect the high temperature lead from corrosion at temperatures of the boiling point of water or less, and would either withstand higher temperatures or melt away and not cause any corrosion at higher temperatures. Heat resistant resins are preferred because they provide a greater length of protected high temperature lead which could be helpful if the point at which the temperature is the boiling point of water moves. Acceptable high temperature resins include polyimide, polyamide-imide, and polyetheretherketone.

The high temperature lead sheath is separated from the high temperature lead by mineral insulation such as magnesium oxide. Copper leads are acceptable and effective for the low temperature leads, but nickel or nickel-chromium clad nickel are preferred for the high temperature leads.

We claim:

1. A wellbore heater comprising:

a porous metal sheet heating element, the porous metal sheet being an electrical resistance heating element; and an electrical insulating material surrounding the porous metal sheet heating element;

wherein there is no casing surrounding the porous metal sheet heating element.

2. The heater of claim 1 wherein the porous metal sheet heating element comprises an expanded metal sheet.

3. The heater of claim 2 wherein the expanded metal sheet is rounded to essentially comply with a portion of a wall of a wellbore.

4. The heater of claim 3 wherein a plurality of expanded metal sheet heating elements are provided and each expanded metal sheet is separated from the other expanded metal sheets.

5. The heater of claim 4 wherein the plurality of expanded metal sheets are electrically connected at a lower extremity.

6. The heater of claim 5 further comprising a power supply to each of the expanded metal sheets at an upper extremity, and wherein each of the power supplies is a different phase of electrical power.

7. The heater of claim 1 wherein the electrical insulating material comprises sand.

8. The heater of claim 1 wherein the electrical insulating material comprises cement.

9. The heater of claim 1 wherein a plurality of expanded metal heating elements are provided and the plurality of heating elements are electrically connected to different phases of alternating electrical power at a powered end and electrically connected to a common ground at a ground end.

10. A method to heat a portion of the earth, the method comprising the steps of:

providing a borehole within the portion of the earth to be heated;

placing an electrical resistance heating element within the borehole, the heating element being a porous metal sheet element; and supporting the heating element within the borehole with electrically insulating material, wherein a metal casing is not provided between the heating element and the earth to be heated.

11. The method of claim 10 further comprising the step of initiating electrical flow through the heating elements by passing electrical current from the heating element to the portion of the earth to be heated at a current effective to remove liquid water from the electrical insulating material; and increasing voltage applied to the heating element as a resistance increases through the electrical heating element.

12. The method of claim 10 wherein a plurality of heating elements are provided; the heating elements are all electrically connected at a lower extremity of the heating elements; and a different phase of electrical power is applied to each of the heating elements at an upper extremity of the heating elements.

13. The method of claim 10 wherein the heating element is selected from the group consisting of an expended metal plate, a wire mesh, and a metal strips connected by spacers.

14. The method of claim 10 wherein the heating element is formed into a shape which conforms to a portion of the wall of the borehole.

* * * * *